US007866658B2

(12) United States Patent
Bokelman et al.

(10) Patent No.: US 7,866,658 B2
(45) Date of Patent: Jan. 11, 2011

(54) MEDIA PICK SYSTEM AND METHOD

(75) Inventors: Kevin Bokelman, San Diego, CA (US); Michael Janczyk, San Deigo, CA (US); Ryan M. Smith, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 11/903,988

(22) Filed: Sep. 24, 2007

(65) Prior Publication Data

US 2009/0079127 A1 Mar. 26, 2009

(51) Int. Cl.
*B65H 3/06* (2006.01)
*B65H 3/52* (2006.01)

(52) U.S. Cl. ..... 271/117; 271/121

(58) Field of Classification Search ..... 271/121, 271/117, 118
See application file for complete search history.

(56) References Cited

U.S. PATENT DOCUMENTS 5,104,112 A * 4/1992 Briggs et al. ..... 271/121
5,183,248 A * 2/1993 Okada et al. ..... 271/127
5,228,673 A 7/1993 Osonoe
5,277,417 A 1/1994 Moritake et al.
5,290,024 A 3/1994 Takahashi
5,485,991 A 1/1996 Hirano et al.
5,868,385 A 2/1999 Embry et al.
5,951,003 A * 9/1999 Nojima et al. ..... 271/121
6,170,701 B1 1/2001 Youn
6,382,620 B1 * 5/2002 Gaarder et al. ..... 271/117
6,485,014 B1 11/2002 Lin
6,554,270 B2 * 4/2003 Yamamoto ..... 271/117
6,585,250 B1 7/2003 Hsiao
6,792,241 B2 * 9/2004 Nakagawa et al. ..... 399/367
6,877,736 B2 * 4/2005 Chung ..... 271/118
7,275,740 B2 * 10/2007 Able et al. ..... 271/10.01
2002/0050680 A1 * 5/2002 Yanagi et al. ..... 271/121
2006/0082043 A1 * 4/2006 Ikeda ..... 271/121
2006/0220300 A1 10/2006 Nakakita et al.
2006/0255526 A1 11/2006 Ginzton
2007/0001375 A1 1/2007 Zhu

FOREIGN PATENT DOCUMENTS

JP 04116035 * 4/1992
JP 03126424 12/1992

* cited by examiner

*Primary Examiner*—Stefanos Karmis
*Assistant Examiner*—Patrick Cicchino

(57) ABSTRACT

A media pick system includes a media support, a pick roller, disposed above media support, configured to selectively contact and pick sheets of media disposed upon the media support, and clearance means, associated with the media support, for providing contact-free clearance around the pick roller during a media out condition.

17 Claims, 4 Drawing Sheets

MEDIA PICK SYSTEM AND METHOD

BACKGROUND

The present disclosure relates generally to media pick and separation systems that are used in devices such as printers, copiers, scanners, facsimile machines and the like. These types of image-forming or image scanning devices typically include a media feeding mechanism that supplies individual sheets of print media (e.g. paper) onto which images are formed or from which images are scanned. Many such devices include a tray that stores an input stack of sheets of media, and a pick mechanism is used to pick the top sheet off of the input stack and advance the sheet to the feeding mechanism.

Many automatic document feeder systems are designed to pick the sheets in the input tray in a discrete manner. That is, the system picks the top sheet off of the stack and starts to feed that sheet into the paper path. Once the leading edge of the sheet trips a flag or sensor, the system changes modes to stop attempting to pick another sheet, and simply feeds this one sheet forward. This type of system produces a relatively large gap between the sheets. A large gap between sheets translates into lower throughput (fewer pages per minute) for the system.

BRIEF DESCRIPTION OF THE DRAWINGS

Various features and advantages of the present disclosure will be apparent from the detailed description which follows, taken in conjunction with the accompanying drawings, which together illustrate, by way of example, features of the present disclosure, and wherein.

DETAILED DESCRIPTION

Figure 1:
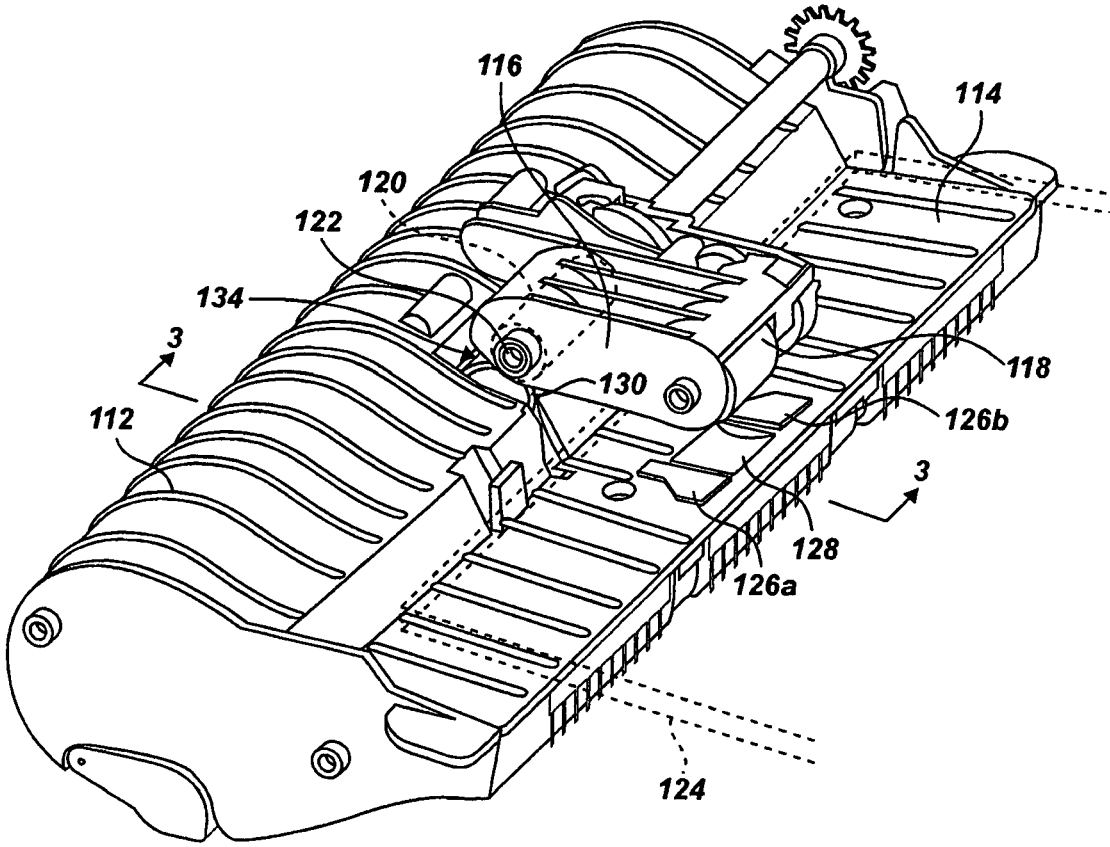
FIG. 1 is a perspective view of one embodiment of a media pick mechanism having a split retard pad and narrow separation roller, showing the pick arm in the raised position.

Reference will now be made to exemplary embodiments illustrated in the drawings, and specific language will be used herein to describe the same. It will nevertheless be understood that no limitation of the scope of the present disclosure is thereby intended. Alterations and further modifications of the features illustrated herein, and additional applications of the principles illustrated herein, which would occur to one skilled in the relevant art and having possession of this disclosure, are to be considered within the scope of this disclosure.

As noted above, automatic document feeding systems have been developed to pick individual sheets from an input tray. Some of these tend to leave a relatively large gap between subsequent sheets—in some cases greater than about 10". Such large gaps between sequential sheets results in much lower throughput, giving the system a lower overall operational speed.

One way to reduce the gap between subsequent sheets of media is via a mode called "tailgate picking." Tailgate picking involves picking sequential sheets with a much smaller fractional gap between sheets, rather than a gap that is closer to the full length of a sheet of media. Advantageously, the inventors have developed a new paper pick system that effectively implements tailgate picking to increase throughput, while at the same time reducing or avoiding multi-picking, torque spikes, and noise that can sometimes occur when more rapid paper picking is attempted.

One embodiment of the inventors' media pick system 110 is depicted in FIGS. 1-4. This system generally includes a pick engine body 112 with a media tray surface 114 and a pivoting pick arm 116 positioned above the media tray surface. The pick arm includes a pick roller 118 and a separation roller 120, and is configured to pivot about the center 122 of the separation roller from a raised position, to a lowered position in which the pick roller contacts the top of a stack 124 of sheets of media (shown in dashed lines in FIG. 3).

Disposed on the media tray surface 114 below the pick roller 118 is a split retard pad, having two pad portions 126*a*, 126*b*, with a semi cylindrical pick roller trough 128 between them. This retard pad supports the media 124 and provides a surface that promotes effective picking of the sheets of media. However, in this new design, rather than having the retard pad directly below the pick roller, the retard pad is split into two pieces, with the trough between the pad portions. The materials of the pick roller and the retard pad can be chosen so that friction between the pick roller and the print media is higher than friction between the print media and the retard pad, which in turn is higher than friction between adjacent sheets of the print media. This helps the pick roller to effectively pick the last sheets of media from a stack throughout the life of the paper pick system.

While the embodiments shown and described herein include a semi cylindrical trough 128 for providing clearance around the pick roller 118 during a paper out condition, it is to be appreciated that other configurations can also be used to prevent contact of the pick roller with other surfaces when the pick arm is fully lowered. For example, the pick roller trough can have a shape other than semi-cylindrical. Indeed, rather than a trough with a curved bottom surface, the media support surface can simply be provided with a rectangular recess or depression. Alternatively, the media support surface can have an opening into which the pick roller drops, the opening having no bottom at all. Other configurations are also possible. Any structure associated with the media support surface that provides clearance around the pick roller when the pick arm is fully lowered, and which also meets other design aspects discussed herein, can be suitable.

The separated portions of the retard pad are spaced to provide lateral clearance with the sides of the pick roller, and the trough provides a forward clearance space for the pick roller. This space allows the pick roller to spin freely during a paper out condition, if the unit is still trying to pick with the pick arm in the fully lowered position. This can happen after the trailing edge of the last sheet of media has left the pick area, and can continue until the trailing edge leaves the scan zone. The trough provides a clearance zone for the pick roller when the pick arm is in the lowered position, so that the pick roller does not contact any other surface—either the retard pad or any other part of the media tray surface. This can prevent a large torque spike that might otherwise occur after the last page has left the pick zone if the system continues to try to pick with the high friction pick roller against the stationary retard pad.

Figure 3:
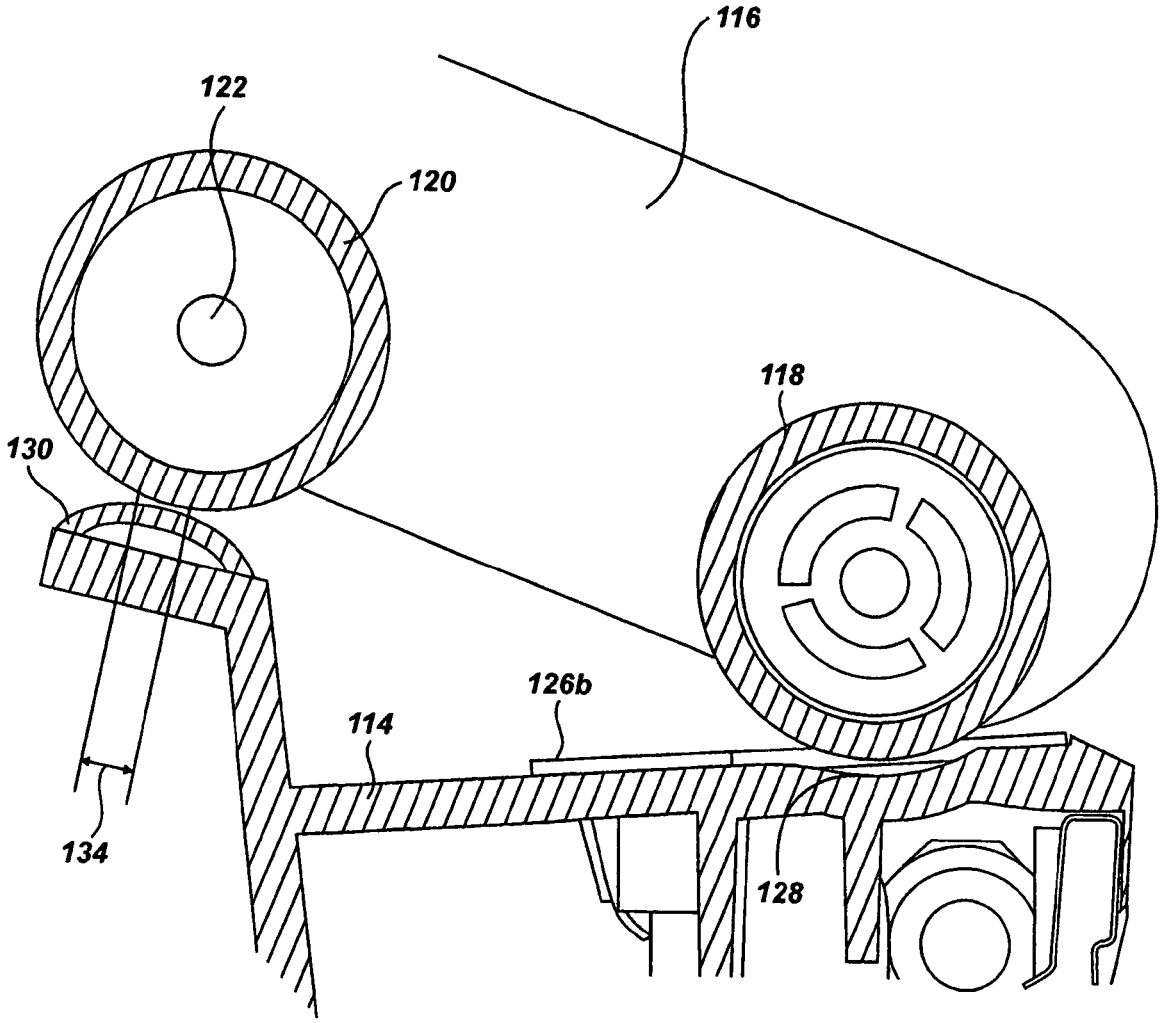
FIG. 3 is a transverse cross-sectional view of the embodiment of FIG. 1, taken through the pick roller trough, showing the relative position of the pick roller in the lowered position.

A cross-sectional view of the pick roller 118 extended down into the pick roller trough 128 is shown in FIG. 3. This view shows the clearance that the pick roller trough provides around the curved surface of the pick roller when the pick arm is in the fully lowered position. The magnitude of forward clearance between the surface of the trough and the curved surface of the pick roller can vary. In one embodiment, the inventors have used a clearance of about 0.75 mm between the curved surface of the roller and the curved trough surface.

Figure 4:
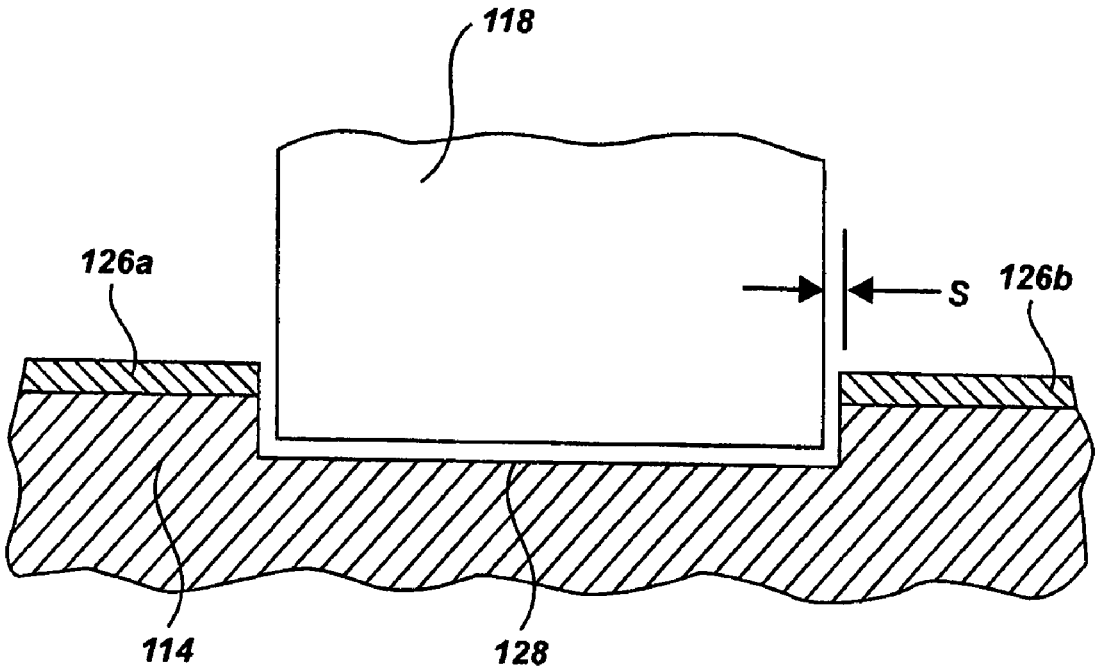
FIG. 4 is a longitudinal cross-sectional view of the embodiment of FIG. 1, taken through the pick roller trough, showing the position of the pick roller relative to the sides and bottom of the pick roller trough when in the lowered position.

Another cross-sectional view of the pick roller 118 positioned in the pick roller trough 128, this view taken at a right angle relative to the viewpoint of FIG. 3, is provided in FIG. 4. This view shows the lateral clearance S between the sides of the pick roller and the sides of the trough and the nearest adjacent edge of the split retard pad portions 126*a*, 126*b*. To avoid friction between the sides of the pick roller and the trough and/or edges of the retard pad portions, it is desirable that the lateral clearance S be at least about 0.5 mm.

At the same time, the lateral clearance between the pick roller 118 and the edges of the retard pad portions 126 cannot be so great that the print media will deflect down into the trough under the downward force of the pick roller, and thus effectively reduce the normal force between the pick roller and the media and contribute to mispicks. It is to be appreciated that the print media spans across the pick roller trough 128, between the split retard pad portions. When the media stack 124 is relatively thick, this span does not cause the print media to deflect significantly under the force of the pick roller. However, as sheets are successively picked and the media stack grows thinner, the stack will tend to bend more and more, potentially bowing away from the pick roller. To help reduce this effect, it is desirable that the clearance between the lateral sides of the pick roller and the sides of the trough/retard pad portions be kept below some maximum dimension that will help prevent excessive deflection or bowing of the print media when the stack is thin. Given likely manufacturing tolerances, the inventors have found that a design lateral clearance S in the range of about 2 mm is considered suitable to accomplish these objectives.

Another feature of this media pick system that contributes to effective tailgate picking is an overall reduction in the normal force of the pick roller against the media stack. During the pick process, it is desirable to maintain the magnitude of the normal force exerted onto the media stack by the pick roller within a predefined range so that the pick roller will properly engage the top sheet in the stack. If the magnitude of the normal force is too low, the pick roller will not be able to frictionally engage the top sheet. If the magnitude of the normal force is too high, multiple sheets may be fed and back tension can be created within the pick system drive mechanism. Additionally, the mechanism that rotates the pick arm can impose a parasitic drag on the printer system, which places a drag on motor torque.

In some pick systems the normal force between the pick roller and the top sheet of the media stack can be maintained in the range of about 100 g. This force level has been found to be suitable for the normal pick mode. However, in tailgate picking mode this normal force level tends to result in increased multi-picks (i.e. the system picks more than one sheet at a time). According to one illustrative embodiment, the step of reducing a normal force of contact between the pick roller and the sheets of media can reduce an incidence of multi-picking during tailgate picking mode. The inventors have found that a reduction in the pick roller normal force of around 40% (e.g. from about 100 g to about 60 g in one embodiment) helps to substantially reduce the incidence of multi-picks. Testing has shown that this force still has sufficient margin against no-picks in both normal and tailgate modes. In another embodiment the pick roller normal force can range from approximately 25 to 120 g.

Those of skill in the art will recognize that the pick roller normal force is inherently related to the coefficient of friction between the pick roller and the media through the equation $F=\mu N$, where N is the normal force, $\mu$ is the coefficient of friction, and F is the drive force that the roller can impart to the media. The drive force F has an influence on the robustness of the media picking system. Consequently, if there is a change in the coefficient of friction $\mu$, a compensation in the normal force N can be provided to achieve the same drive force F. The inventors believe that a coefficient of friction in the range of about 1 to about 1.3 between the pick roller and the print media is suitable. In one embodiment the inventors have used materials for the pick roller that provide a coefficient of friction of about 1.25 between the pick roller and print media. EPDM elastomer material, cellular urethane, and silicone are considered suitable materials for the pick roller. Other materials can also be used.

Similarly, to maintain the desired hierarchy of frictional forces, the materials of the pick roller 118 and retard pad 126 can be selected to provide a frictional coefficient in the range of about 0.9 to about 1.3. The pick roller materials mentioned above are suitable in this respect, and can be used with a retard pad of cork to provide the desired level of friction.

Another design feature of this pick system relates to the separation pad 130. As noted above, some media pick systems include a separation roller that is narrower than the adjacent separation pad. The inventors have found that where the separation pad is wider than the separation roller, the edges of the roller can dig into the pad over time, because the roller is generally of a harder material than the pad. This leads to uneven wear of the separation pad, and also produces noise during the paper picking process, because of the uneven surfaces.

Figure 2:
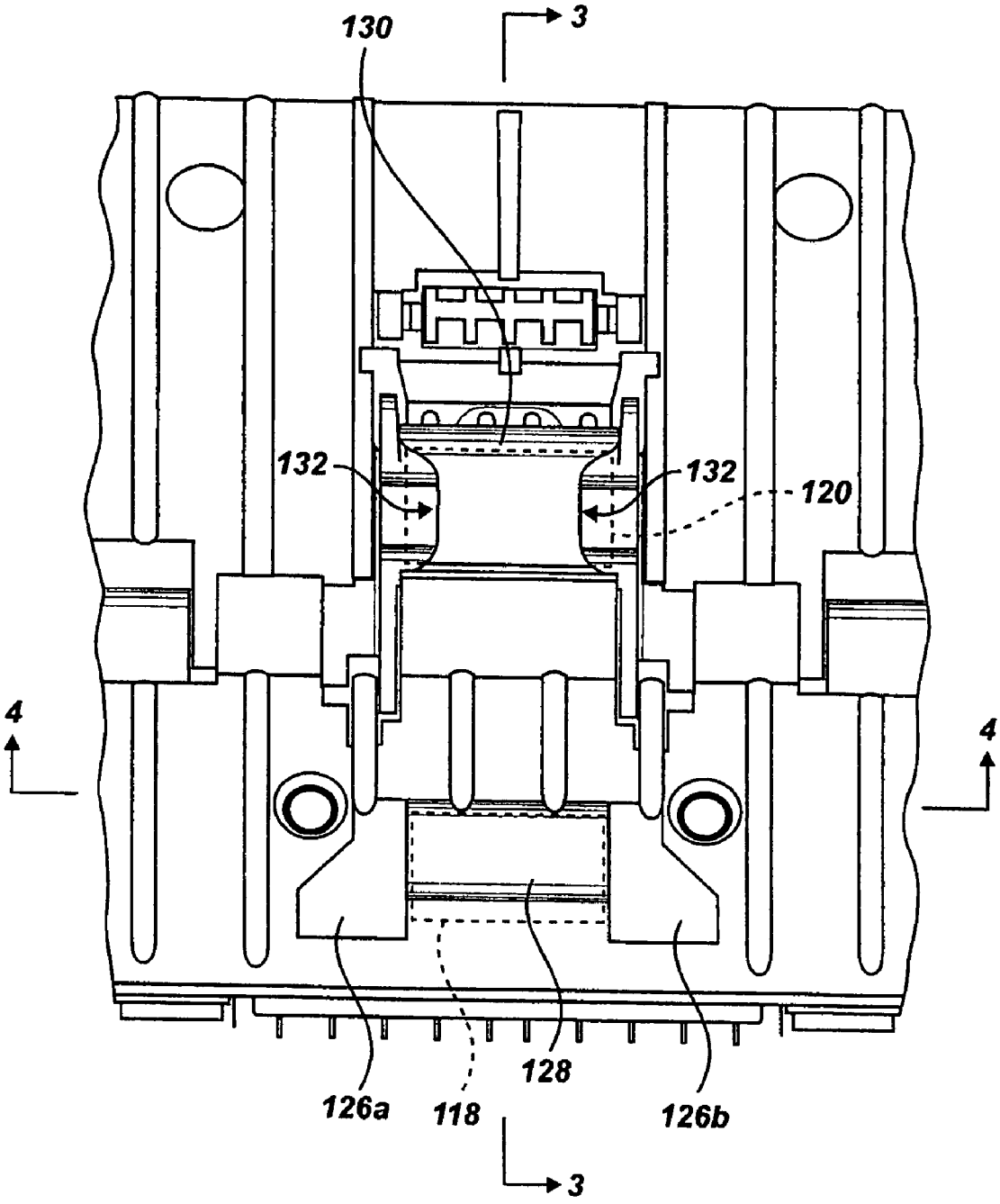
FIG. 2 is a top view of the pick mechanism embodiment of FIG. 1, with the pick arm removed to show the retard pad, pick roller trough and separator pad.

Shown in FIG. 2, the inventor's new design includes a separation pad 130 having a narrowed portion 132 in the region of the nip 134 between the separation pad and the separation roller 120. This narrowed region in the separation pad prevents the edges of the separation roller from coming into contact with the separation pad and digging into it, which helps maintain a smooth surface on the separation pad. The degree to which the separation pad is narrower than the separation roller is related to at least two factors. At one extreme, if the separation pad is too narrow it will tend to wear out more quickly. Thus for the sake of longevity it is desirable to have the separation pad be as wide as possible. On the other hand, the goal of preventing the edges of the separation roller from digging into the separation pad suggests that the design of the system should be such that the edges of the roller never cross the outer edge of the pad. This can be accomplished by designing the separation pad and roller to have sizes such that the separator pad always lies within the outside edges of the separation roller even in the worst case of positioning of all parts in view of manufacturing and assembly tolerances and variations. The inventors believe that the combination of the reduced pick roller normal force and the narrower separation pad prevents multi-picks that otherwise might occur during tailgate picking, and also reduces noise.

Like the pick roller 118, the separation roller 120 can be of EPDM elastomer, cellular urethane, silicone, or other materials. The separation pad 130 can also be of silicone, though again, this material is generally softer than the material of the separation roller. Where the separation roller is of substantially the same material as the pick roller, the coefficient of friction between the separation roller and print media will be substantially the same as described above with respect to the pick roller. The materials of the separation roller and the separation pad are frequently chosen so that friction between the separation roller and the print media is higher than friction between the print media and the separation pad, which in turn is higher than friction between adjacent sheets of the print media. It is desirable that this hierarchy of frictional forces continue throughout the life of the paper pick system and in various environmental conditions. This helps promote consistent picking of the media, while also preventing multiple sheets from being picked. To provide the desired hierarchy of frictional forces, the coefficient of friction between the separation pad and separation roller can be in the range of from about 1 to about 1.3.

The present media pick system thus uses a narrower separation pad in combination with a reduced pick arm normal force and a split retard pad and pick roller trough to allow effective tailgate picking without torque spikes and pick errors. The inventors have found that a media pick system having this combination of features can significantly reduce the gap between subsequent pages and thereby increase throughput in a media picking system. In one embodiment, the system reduced the gap between subsequent sheets from about 10.7" to about 2", or by more than 67%. At the same time, this system reduces system noise and has a relatively low cost to implement.

It is to be understood that the above-referenced arrangements are illustrative of the application of the principles disclosed herein. It will be apparent to those of ordinary skill in the art that numerous modifications can be made without departing from the principles and concepts of this disclosure, as set forth in the claims.

What is claimed is:

1. A media pick system, comprising:

a media support surface;

a trough, downwardly extending in the media support surface;

a pair of retard pads, attached to the media support surface on opposing lateral sides only of the trough, the pair of retard pads extending up to, and terminating at, the opposite lateral sides of the trough;

a pivotable pick arm with a pick roller, having a fully downwardly rotated position with the pick roller in the trough between the retard pads and in contact with only the pick arm during a media out condition; and a separation roller having a first width, attached to the pick arm at a pivot point of the pick arm, disposed in contact against a nip region of a separation pad, the separation pad having a second width that is narrower than the first width of the separation roller in the nip region; wherein the separation pad includes a wide portion outside the nip region, and a narrowed portion having the second narrower width in the nip region.

2. A media pick system in accordance with claim 1, wherein the pick roller has a lateral clearance of at least about 0.5 mm between opposing lateral edges thereof and a nearest adjacent edge of the trough and an adjacent retard pad portion.

3. A media pick system in accordance with claim 1, wherein the retard pads and pick roller are of materials selected to have a coefficient of friction of from about 0.9 to 1.3.

4. A media pick system in accordance with claim 3, wherein the retard pads are of cork, and the pick roller is of a material selected from the group consisting of EPDM, cellular urethane and silicone.

5. A media pick system in accordance with claim 1, wherein the separation pad and separation roller are of materials selected to have a coefficient of friction of from about 1 to 1.3.

6. A media pick system in accordance with claim 1, wherein the pick arm presses the pick roller downwardly against a stack of media supported upon the media support surface with a normal force in the range of from about 25 g to about 120 g.

7. A media pick system in accordance with claim 1, wherein the pick arm presses the pick roller downwardly against a stack of media supported upon the media support surface with a normal force of about 60 g and having an average coefficient of friction between the pick roller and the media of about 1.25.

8. A media pick system in accordance with claim 1, wherein the trough is defined by a curved surface downwardly extending from the media support surface.

9. A media pick system, comprising:

a media support;

a pick roller, disposed above the media support, configured to selectively contact and pick sheets of media disposed upon the media support;

clearance means, associated with the media support, for providing contact-free clearance around the pick roller during a media out condition;

a pair of retard pads, positioned on opposing lateral sides only of the clearance means; and a separation roller having a first width, attached to the pick arm at a pivot point of the pick arm, disposed in contact against a nip region of a separation pad, the separation pad having a second width that is narrower than the first width of the separation roller in the nip region; wherein the separation pad includes a wide portion outside the nip region, and a narrowed portion having the second narrower width in the nip region.

10. A media pick system in accordance with claim 9, wherein the clearance means comprises a semi cylindrical trough, defined by a downwardly extending curved surface in the media support.

11. A media pick system in accordance with claim 9, wherein the clearance means provides a clearance of at least about ½ mm and not greater than about 2 mm adjacent to lateral sides of the pick roller.

12. A media pick system in accordance with claim 9, wherein a coefficient of friction between the pick roller and the sheets of media is in the range of about 1.0 to about 1.3, and wherein the pick roller is configured to contact the sheets of media with a normal force in the range of from about 25 g to about 120 g.

13. A media pick system in accordance with claim 9, further comprising:

a separation pad, having a first width; and a separation roller, in contact with the separation pad, having a second width that is wider than the first width, the separation pad and separation roller defining a nip region that is positioned to receive print media after picking of the media by the pick roller.

14. A method for picking print media, comprising the steps of:

providing sheets of print media upon a media support surface;

supporting the sheets of print media over a pick roller trough disposed in the media support surface using a pair of retard pads which are positioned on opposing lateral sides only of the pick roller trough, the retard pads extending up to, and terminating at, the opposing lateral sides of the pick roller trough;

selectively lowering a pick roller to contact and pick the sheets of print media in a tailgate picking mode;

allowing the pick roller to drop into the pick roller trough after all sheets have been picked, without contacting any other surface; and passing the sheets of print media, after picking by the pick roller, into a nip region between a separation roller attached to the pick arm at a pivot point of the pick arm, the separation roller having a first width and a separation pad having a second narrower width, wherein the separation pad includes a wide portion outside the nip region, and a narrowed portion having the second narrower width in the nip region.

15. A method in accordance with claim 14, wherein the step of picking sheets of the print media in the tailgate picking mode comprises sequentially picking sheets of print media with a gap between successive sheets of less than a sheet length dimension.

16. A method in accordance with claim 15, wherein the step of picking sheets of the print media in the tailgate mode comprises sequentially picking sheets of print media with a gap between successive sheets of about 2 inches.

17. A method in accordance with claim 14, further comprising reducing a normal force of contact between the pick roller and the sheets of media to reduce an incidence of multi-picking during tailgate picking mode.

* * * * *